US007614120B2

(12) United States Patent
Isbell

(10) Patent No.: US 7,614,120 B2
(45) Date of Patent: Nov. 10, 2009

(54) SEED CLEANER

(75) Inventor: Darrell Isbell, Richmond Hill, GA (US)

(73) Assignee: Lummus Corporation, Savannah, GA (US)

( * ) Notice: Subject to any disclaimer, the term of this patent is extended or adjusted under 35 U.S.C. 154(b) by 15 days.

(21) Appl. No.: 12/024,318

(22) Filed: Feb. 1, 2008

(65) Prior Publication Data

US 2009/0194463 A1 Aug. 6, 2009

(51) Int. Cl.
*D01B 1/04* (2006.01)

(52) U.S. Cl. ..... 19/41

(58) Field of Classification Search ..... 19/40–47
See application file for complete search history.

(56) References Cited

U.S. PATENT DOCUMENTS 6,038,741 A * 3/2000 Winn ..... 19/48 R
7,308,734 B2 * 12/2007 Mizer, Sr. ..... 19/39
2006/0196011 A1 9/2006 Mizer

OTHER PUBLICATIONS

Verdery, M.C.; "Cooling, Storing and Cleaning of Cotton"; Houston, Texas, Jun. 1976.

* cited by examiner

*Primary Examiner*—Shaun R Hurley
(74) *Attorney, Agent, or Firm*—Smith, Gambrell & Russell

(57) ABSTRACT

An improved seed cleaner utilizes a rock trap sequentially followed by an aspiration hood which performs preliminary cleaning before passing seed to a rotary seed cleaner mounted over a shaker to yield a cottonseed cleaning system has enhanced the removal of loose lint from the seed before the seed is passed over any shaker screens to prevent clogging of the shaker screens by the loose lint.

7 Claims, 1 Drawing Sheet

SEED CLEANER

BACKGROUND OF THE INVENTION

The present invention relates to the field of seed cleaning and more particularly to the cleaning of seed such as cotton seed in which the seed bears fiber and lint that can be used if separated there from and in which the seed itself has commercial utilization when properly processed. Cotton seed is processed into three major products: cotton linters (lint remaining on the seed), cooking oil and meal (used for animal feed). Additionally, cotton seed oil is now being used to produce Bio-Fuels. In the field of cleaning seed, primarily cotton seed, two main systems for cleaning seed are currently used namely: oscillating shaker trays and/or air aspiration. The oscillating shaker trays are very widely used throughout the Cotton Seed Processing Industries. A series of oscillating shakers (trays) are covered with various sizes of perforated metal screens for the seed to pass through and the larger trash to pass over, and a series of smaller perforated metal screens are used for the fine product to pass through and the seed to pass over. The two most common models are the Four-Tray Seed Cleaner and the Two-Tray Seed Cleaner. Longer fiber remaining on the cotton seed has become an issue in maintaining capacity of the apparatus as well as cleanliness of the seed because the longer fiber entangles on the perforated screen as the seed passes through it, blinding the screen and allowing more seed to pass over and not through the screens.

To help correct this problem, many seed processors have installed an air wash (Air Cascade), which is a counter-flow system. As the seed is fed into the air cascade, the air is pulled upwards, lifting some of the loose lint and light trash with it. This helps decrease the load on the perforated screen at the seed cleaners, but not significantly, due to the process flow pushing loose lint into the discharge seed stream. This loose lint entangles itself on the perforated screens, significantly reducing efficiency of the shaker tray cleaning process

SUMMARY OF THE INVENTION

It is an object of the present invention to provide remedies to allow the seed cleaning to be done without the influence of longer fiber on the seed reducing the cleaning rate and efficiency.

It is a further object to optimize the cleaning rate for any grade of cotton seed thus improving the capacity and efficiency of the cotton seed processing system.

It is a further object to provide a maintenance free self cleaning system.

A still further object of this invention is to increase the capacity (feed rate), thus decreasing the amount of machinery, power, and air emissions required in operating the machinery.

It is a further objective to increase process capacity while reducing air emission per ton of seed.

These and other objects and advantages of the invention will become apparent from the following detailed description of the preferred embodiment of the invention.

BRIEF DESCRIPTION OF THE DRAWINGS

An apparatus for cleaning seeds is depicted in the accompanying drawing which form a portion of this disclosure and wherein a side elevation of the invention shown partially broken away is provided.

DESCRIPTION OF THE PREFERRED EMBODIMENT

Figure 1:
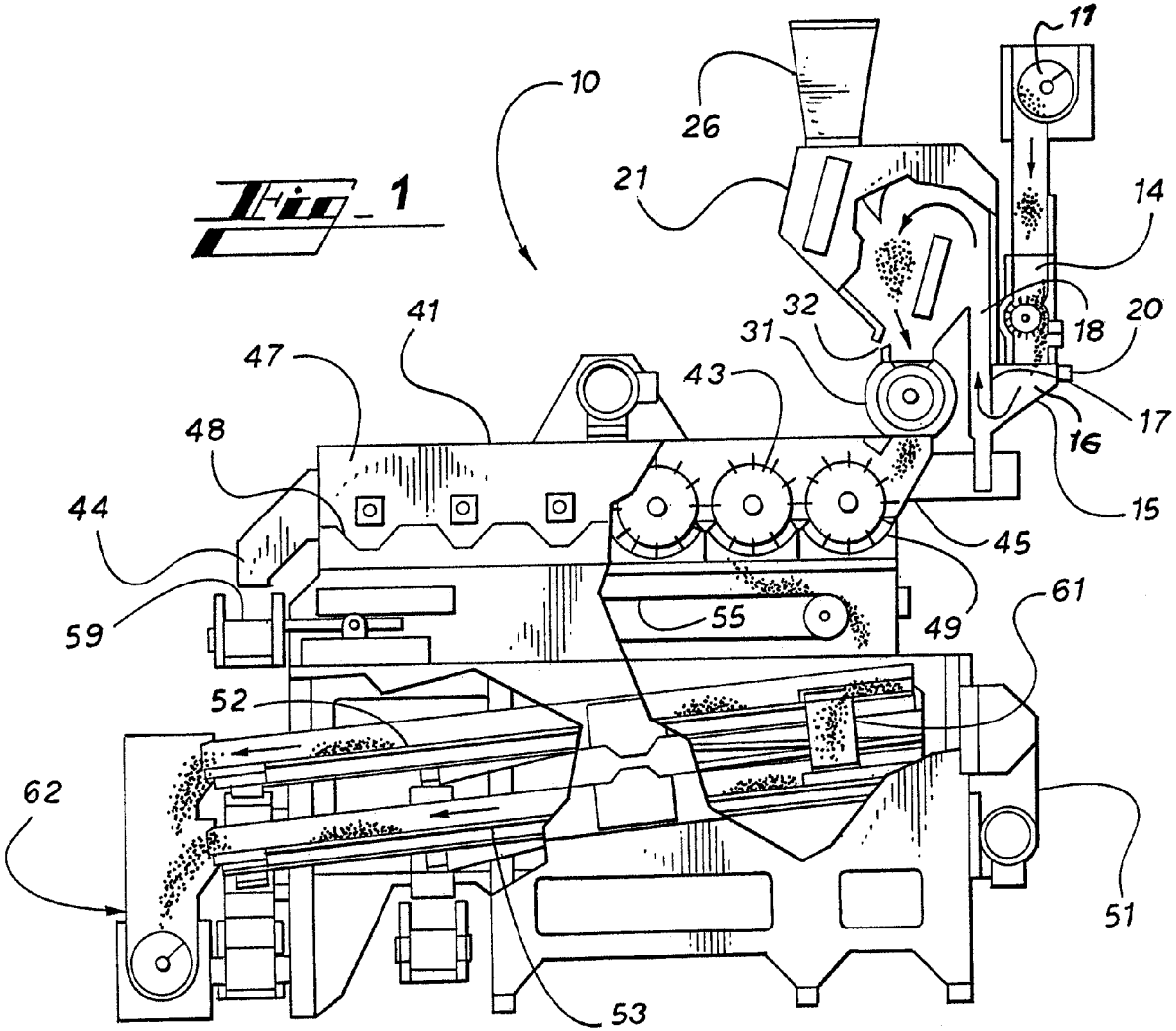

Referring to the drawing for a clearer understanding of the invention, it may be seen that the preferred embodiment of the invention contemplates a combination of aspiration separation and multiple gravity separation apparatus to yield a superior seed cleaner. It will be understood that various moving parts such as the rotary airlock, rotary seed cleaner and tray cleaners are conventionally powered, therefore a discussion of the power train and drive elements are not germane to the present disclosure but are well within the skill of one of ordinary skill in the art.

Cotton seed, having been ginned, is fed conventionally by a screw conveyor 11 into the Seed Cleaner 10 via a volumetric roll feeder 14 which regulates the volume by controlling the speed of the roll. The seed is fed into a "Rock Trap" density separator 15 where the heavies (Rocks, Metal, etc.) will fall out the bottom and the Fuzzy Cotton Seed is lifted by air created by an external Fan. The Seed is fed into a fountain-type separator or aspiration hood 21 where the seed enters at high air velocity turning 90 degrees and with a sudden expansion of area allowing the air velocity to decrease and allowing the seed to fall and any light product (i.e. lint, hulls etc.) to be lifted. The seed is fed into a rotary valve 31, then into the Rotary Seed Cleaner 41. The Rotary Seed Cleaner is comprised of a series of spiked cylinders 43 that rotate at various RPM and convey the seed through the Grid Bars 49 located under the cylinders. The seed passes (drops) through the Grid Bars 49, allowing the larger product (unginned Cotton, Bolls, etc.) to stay inside the Rotary Seed Cleaner and be discharged out the end 44 ont conveyor 45 for disposal or further processing. The seed is conveyed to the end of the Two-Tray Cleaner 59 where the seed passes over a series of screens and the small particles are separated from the seed. The clean seed is discharged to the seed conveyor 62 for further processing. The forgoing components and their interaction are discussed more fully hereinafter.

ROCK TRAP: The cotton seed is fed via a volumetric feeder 14 into the rock trap 15 which is a downwardly converging plenum 16, having a vertical baffle 17 interposed between the feeder and a generally upwardly opening outlet 18. Air is drawn through the plenum through the make up air vents 20 just below the feeder 14 as the seed and debris enter the rock trap, entraining the seed and lighter debris in the airflow around baffle 17 thus turning the cotton seed 180 degrees at a high velocity. The rocks and other heavy objects are unable to recover from their downward trajectory and are discharged out the bottom of the plenum. The cotton seed, which is lighter and more aerodynamic, is lifted by the high velocity air stream. The rock trap is designed to incorporate the difference in the density and aerodynamic characteristics between the cotton seed, rocks and other foreign objects, thus allowing the cotton seed to be lifted due to chamber area and specific air velocities in each section of the rock trap.

ASPIRATION HOOD: The air aspiration hood 21 receives the high velocity air and entrained cotton seed from rock trap 15 and acts as an air separation chamber for the rock trap. As the seed is lifted into the chamber at high velocity, the air velocity is suddenly decreased due to the change in area of the aspiration hood, allowing cotton seed to drop into the rotary air lock 31 and pass there through to the rotary seed cleaner 41. The aspiration hood chamber is designed to turn the seed downward, thus influencing the separation from the air stream. The chamber is also designed to maintain an air velocity high enough to lift any loose fiber and other light product from the cotton seed and discharge this debris along with the air through outlet 26. A make-up air intake 32 is positioned to help influence the lifting of any loose lint and light trash away from the seed by allowing for additional air inflow from adjacent the rotary airlock. The Chamber is also designed to effectively remove the loose lint from the seed stream, thus decreasing the influence of the cotton seed pushing the loose lint down into the rotary seed cleaner 41. The separation of any large foreign products from the seed at the beginning of the process prevents any possible damage down stream. This, coupled with the aspiration hood or scalper allows any light product (Lint, Hulls, etc.) to be lifted more efficiently from the seed due to the sudden expansion and decrease in air velocity. In the past, this has been done with an air cascade, which is a zigzag-type chamber where the seed is fed in the top and falls through an air stream lifting the lighter product. The aspiration hood is a fountain design that reverses the trajectory of the seed to a downward direction, with a separating air current transverse to the seed stream taking reducing the volume of the lighter materials being carried down with the seed. The higher input velocity to the aspiration hood and fountain design also help in separating the lumps of cotton seed into individual lots, thus improving the cleaning efficiency. The air stream is controlled in part by the make air intake 32 at the bottom of the aspiration hood near the rotary seed cleaner.

ROTARY SEED CLEANER: The rotary seed cleaner 41 incorporates a series of spiked cylinders 43 rotating at increasing speeds. This speed change from cylinder to cylinder allows the cotton seed that tends to lump together to be pulled apart, thus allowing the seed to pass through the grid bars 49, therefore increasing the cleaning efficiency. These grid bars are each rods that are installed in a drawer type frame 48 at a specific spacing on a radius to the spiked cylinder for the variety of seed being cleaned. These frames 48 are removable from each side to facilitate the removal or inspection of the grid bars and replacement for different seed varieties. That is to say, the frames carrying the bars of different spacings may be interchanged or the bars may be adjusted on the frames and reinserted. The spiked cylinders are mounted on removable stub shafts 45. These stub shafts are bolted to the cylinder and can be removed through the housing 47. These stub shafts are designed to remove all shearing stress from the mounting hardware.

Unlike the rotary pin wheel assembly shown in the Mizer U.S. patent application Ser. No. 11/073,375, the Grid Bars are designed for the seed to pass between the bars, allowing the larger product to pass over the bars and be discharged out the end 44. In the past, the seed has always been fed over a series of screens using a shaker arrangement, where the seed is retained in the unit as it passes over a series of metal screens, allowing the fines to be separated and the seed to pass out the end of the unit. The efficiency of the unit has been greatly improved with the use of Grid Bars in this arrangement, as the linty seed has a tendency to tag and blind over the metal screens. The diameter of the Grid Bars is such that the fiber on the seed is too short to allow any tagging and the rotating cylinders help keep the unit cleaned.

The resistance of the seed being carried over the grid bars is overcome by the spiked cylinders which helps to further separate the seed lumps into individual seeds. Any un-ginned seed (seed with excess fiber remaining on it) will pass over the grid bars and will be discharged out the end, along with any large trash to be further separated by additional cleaning equipment. The seed that passes through the grid bars is conveyed to one end via a flat belt conveyor 55 to be fed onto the two-tray seed cleaner 51. As the seed is carried over the grid bars, any lint or linty seed that is entangled on the bars is removed by incoming seed, thus making the bars self-cleaning. Due to the cleaning efficiency of the grid bars, overall process efficiency is increased dramatically. This efficiency relates to machine capacity, reduced power consumption, and reduced air emissions.

TWO-TRAY SEED CLEANER: The seed that is discharged from the rotary seed cleaner belt conveyor is fed to the two-tray seed cleaner 51. This cleaner is comprised of two shaker trays (decks) 52 and 53 where the seed stream is split in half via tray divider spout 61. The seed passes over a series of perforated metal screens where the fine product goes through the screens and the clean seed passes over the screens to be discharged out the end to the processing facility.

Incorporating the Rock Trap, Aspiration Hood, and Rotary Seed Cleaner over a conventional cleaning system has allowed the removal of loose lint from the seed before it is passed over any shaker screens, thus eliminating a problem that has always plagued the Cotton Seed Processing Industry. It is to be understood that the form of the invention shown is a preferred embodiment thereof and that various changes and modifications may be made therein without departing from the spirit of the invention or scope as defined in the following claims.

What is claimed is:

1. An apparatus for cleaning seeds having a fibrous coating comprising in combination:

A feeder for metering a flow of seeds and commingled debris into a plenum, said plenum having an opening at a bottom portion thereof for removal of heavy debris, an inlet for an air stream flowing through said plenum and a generally upwardly opening outlet for discharge of said air stream with seeds and lighter debris entrained therein;

An aspiration hood connected to said upwardly opening outlet and defining an increased volume space wherein the velocity of said air stream is decreased, said aspiration hood having an upwardly opening discharge through which said air stream and lighter debris entrained therein is removed and a bottom discharge for removal of seeds and debris no longer entrained with said air stream;

A rotary seed cleaner operatively connected to said bottom discharge for receiving seeds and debris said rotary cleaners including grid bars spaced apart sufficiently to allow individual seeds of a selected size to pass there between and at least one rotary sweep to move said seeds and trash across said grid bars; and, A plurality of driven shaker trays positioned to receive seeds passing through said grid bars and convey said seeds to a seed outlet, said shaker trays having apertures therein to allow small debris to pass through.

2. An apparatus as described in claim 1 wherein, said grid bars are carried on a frame removably mounted to a housing about said rotary cleaner, such that said grid bars may be removed.

3. An appratus as described in claim 2 wherein additional grid bars having a different spacing on a frame for removable mounting in said housing about said rotary cleaner, such that said grid bars may inserted in said rotary cleaner.

4. An apparatus for cleaning seeds having a fibrous coating comprising in combination:

A plenum having an inlet for seeds and commingled debris, an opening at a bottom portion thereof for removal of heavy debris, an inlet for an air stream flowing through said plenum and a generally upwardly opening outlet for discharge of said air stream with seeds and lighter debris entrained therein;

An aspiration hood connected to said upwardly opening outlet and defining an increased volume relative to said outlet having an upwardly opening discharge through which said air stream and lighter debris entrained therein is removed and a bottom discharge for removal of seeds and debris no longer entrained with said air stream;

A rotary seed cleaner operatively connected to said bottom discharge for receiving seeds and debris said rotary cleaner including grid bars spaced apart sufficiently to allow individual seeds of a selected size to pass there between and at least one rotary sweep to move said seeds and trash relative to said grid bars; and, At least one driven shaker tray positioned to receive seeds and small debris passing through said grid bars and convey said seeds to a seed outlet, said shaker trays having apertures therein to allow small debris to pass through.

5. Apparatus as described in claim 4 further comprising a roll feeder affixed to said plenum and communicating there with to feed seeds at a predetermined rate into said air stream.

6. Apparatus as described in claim 5 wherein said rotary seed cleaner is operatively connected to said bottom discharge by an air lock which iteratively passes seeds and small debris to said rotary seed cleaner.

7. A method for cleaning seeds having a fibrous coating comprising in combination:

Defining an airflow sufficient to entrain said seeds and a portion of said debris within a plenum having an inlet for seeds and commingled debris, an opening at a bottom portion thereof for removal of heavy debris, and a generally upwardly opening outlet for discharge of said air stream with seeds and lighter debris entrained therein;

Expanding the volume into which said air stream drawn to separate said seeds from said airstream in an aspiration hood having an upwardly opening discharge through which said air stream and lighter debris entrained therein is removed and a bottom discharge for removal of seeds and debris no longer entrained with said air stream;

Urging said separated seeds and debris across a plurality of grid bars spaced apart sufficiently to allow individual seeds of a selected size to pass there between using at least one rotary sweep to move said seeds and trash relative to said grid bars; and, Separating said seeds from said small debris passing through said grid bars using at least one shaker tray having apertures therein to allow small debris to pass through.

* * * * *